United States Patent [19]

Worrall et al.

[11] Patent Number: 4,890,682

[45] Date of Patent: Jan. 2, 1990

[54] APPARATUS FOR VIBRATING A PIPE STRING IN A BOREHOLE

[75] Inventors: Robert N. Worrall; Ivo P. J. M. Stulemeijer, both of Rijswijk, Netherlands

[73] Assignee: Shell Oil Company, Houston, Tex.

[21] Appl. No.: 348,186

[22] Filed: May 5, 1989

[30] Foreign Application Priority Data

May 16, 1986 [GB] United Kingdom ..... 8612019

[51] Int. Cl.[4] ..... E21B 4/02; E21B 7/04; E21B 7/24

[52] U.S. Cl. ..... 175/61; 175/106; 175/107; 175/296; 175/298

[58] Field of Search ..... 166/177, 178, 104, 286, 166/301, 98; 175/55, 56, 61, 106, 107, 296, 297, 298

[56] References Cited

U.S. PATENT DOCUMENTS

| | | | |
|---|---|---|---|
| 2,287,157 | 6/1942 | Wolff | 175/296 X |
| 2,635,852 | 4/1952 | Snyder | 175/296 X |
| 2,641,445 | 6/1953 | Snyder | 175/107 X |
| 2,738,956 | 3/1956 | Bielstein | 175/296 X |
| 2,806,533 | 9/1957 | Fleck | 166/45 |
| 2,868,511 | 1/1959 | Barrett | 175/296 X |
| 2,942,851 | 6/1960 | Beck | 175/296 X |
| 3,139,933 | 7/1964 | Golden | 166/178 |
| 3,193,027 | 7/1965 | Bodine | 166/177 X |
| 3,213,941 | 10/1965 | Nelson | 175/296 X |
| 3,235,014 | 2/1966 | Brooks | 173/57 |
| 3,262,507 | 7/1966 | Hansen | 175/56 |
| 3,318,397 | 5/1967 | Combes | 175/107 X |
| 3,353,362 | 11/1967 | Lubinski | 61/53.5 |
| 3,361,220 | 1/1968 | Brown | 175/296 X |
| 3,368,632 | 2/1968 | Lebelle | 173/49 |
| 3,425,499 | 2/1969 | Fisher | 173/125 |
| 3,433,311 | 3/1969 | Lebelle | 173/49 |
| 3,452,830 | 7/1969 | Gendron et al. | 175/55 |
| 3,477,237 | 11/1969 | Orkney | 61/53.5 |
| 3,509,948 | 5/1970 | Besnard | 173/44 |
| 3,532,174 | 10/1970 | Diamantides et al. | 175/56 |
| 3,544,075 | 12/1970 | Sugden | 259/1 |
| 3,564,932 | 2/1971 | Lebelle | 74/61 |
| 3,570,611 | 3/1971 | Riziuc et al. | 175/296 |
| 3,610,347 | 10/1971 | Diamantides et al. | 175/56 |
| 3,616,703 | 11/1971 | Waschulewski et al. | 74/87 |
| 3,633,688 | 1/1972 | Bodine | 175/55 |
| 3,682,258 | 8/1972 | Kelly et al. | 175/96 |
| 3,783,954 | 1/1974 | Bodine | 173/49 |
| 3,800,889 | 4/1974 | Bauer | 175/19 |
| 3,807,512 | 4/1974 | Pogonowski et al. | 175/296 X |
| 3,808,820 | 5/1974 | Bodine | 61/53.5 |
| 3,860,902 | 1/1975 | Galle | 340/18 LD |
| 3,920,083 | 11/1975 | Makita | 173/49 |
| 3,926,267 | 12/1975 | Svirschevsky et al. | 175/19 |
| 4,018,290 | 4/1977 | Schmidt | 173/49 |
| 4,291,395 | 9/1981 | Holmes | 367/83 |
| 4,295,535 | 10/1981 | Crase et al. | 175/107 X |
| 4,299,279 | 11/1981 | Bodine | 166/72 |
| 4,342,364 | 8/1982 | Bodine | 166/249 |
| 4,384,625 | 5/1983 | Roper et al. | 176/56 |
| 4,402,495 | 9/1983 | Dyer | 267/125 |
| 4,403,665 | 9/1983 | Bodine | 175/ |
| 4,429,743 | 2/1984 | Bodine | 166/177 |
| 4,436,452 | 3/1984 | Bodine | 173/49 |
| 4,553,443 | 11/1985 | Rossfelder et al. | 74/22 R |
| 4,557,295 | 12/1985 | Holmes | 137/813 |
| 4,630,689 | 12/1986 | Galle et al. | 175/56 |
| 4,667,742 | 5/1987 | Bodine | 166/301 |
| 4,673,037 | 6/1987 | Bodine | 166/249 |

FOREIGN PATENT DOCUMENTS 1198328 7/1970 United Kingdom .

*Primary Examiner*—Stephen J. Novosad

[57] ABSTRACT

A jarring apparatus is provided for vibrating a pipe string in a borehole. The apparatus thereto generates at a downhole location longitudinal vibrations in the pipe string in response to flow of fluid through the interior of said string.

20 Claims, 3 Drawing Sheets

APPARATUS FOR VIBRATING A PIPE STRING IN A BOREHOLE

BACKGROUND OF THE INVENTION

The invention relates to an apparatus for generating vibrations in a pipe string, such as a drill string carrying a rotary drill bit, in a borehole penetrating subsurface earth formations.

When drilling highly deviated holes and/or horizontal holes with or without drill string rotation, the gravity force acting on a length of drill pipe as it lies on lowside of hole, when resolved in the direction of the hole, is insufficient to overcome friction in order to advance the drill string as the bit drills off bit weight. Thus there is a need for an apparatus which is able to move a drill pipe string through a borehole in case friction between the borehole wall and the string is high. It may also be needed to compact a gravel packing or cement lining by vibration, or to fish a stuck drill string or other tubulars, such as production liners or casing strings, gravel pack screens, etc., from a borehole.

SUMMARY OF THE INVENTION

In order to vibrate a pipe string for the above purposes, the apparatus according to the invention is provided with means for generating longitudinal vibrations along the central axis of the string at a downhole location in response to the flow of fluid through the interior of the string. If the apparatus is mounted in a drill string, then the apparatus may be located above the bit and/or at intervals in the drill string. These locations in the drill string may be chosen to coincide with points where the maximum amplitude of axial displacement of longitudinal vibration (anti node) would occur were the string to vibrate longitudinally in resonance under certain conditions of flow, rotation, tension, compression, temperature, pressure, etc. Under certain circumstances the string may be designed and operated so that longitudinal standing waves are set up. The apparatus according to the invention may be used to initiate and maintain such standing waves in the drill string during drilling or while lowering or raising the drilling assembly through the borehole.

BRIEF DESCRIPTION OF THE DRAWINGS

Other and further objects, features and advantages of the present invention will be readily apparent to those skilled in the art upon reading of the following disclosure when taken in conjunction with the accompanying drawings, in which.

DETAILED DESCRIPTION OF THE PREFERRED EMBODIMENTS

Figures 1, 2:
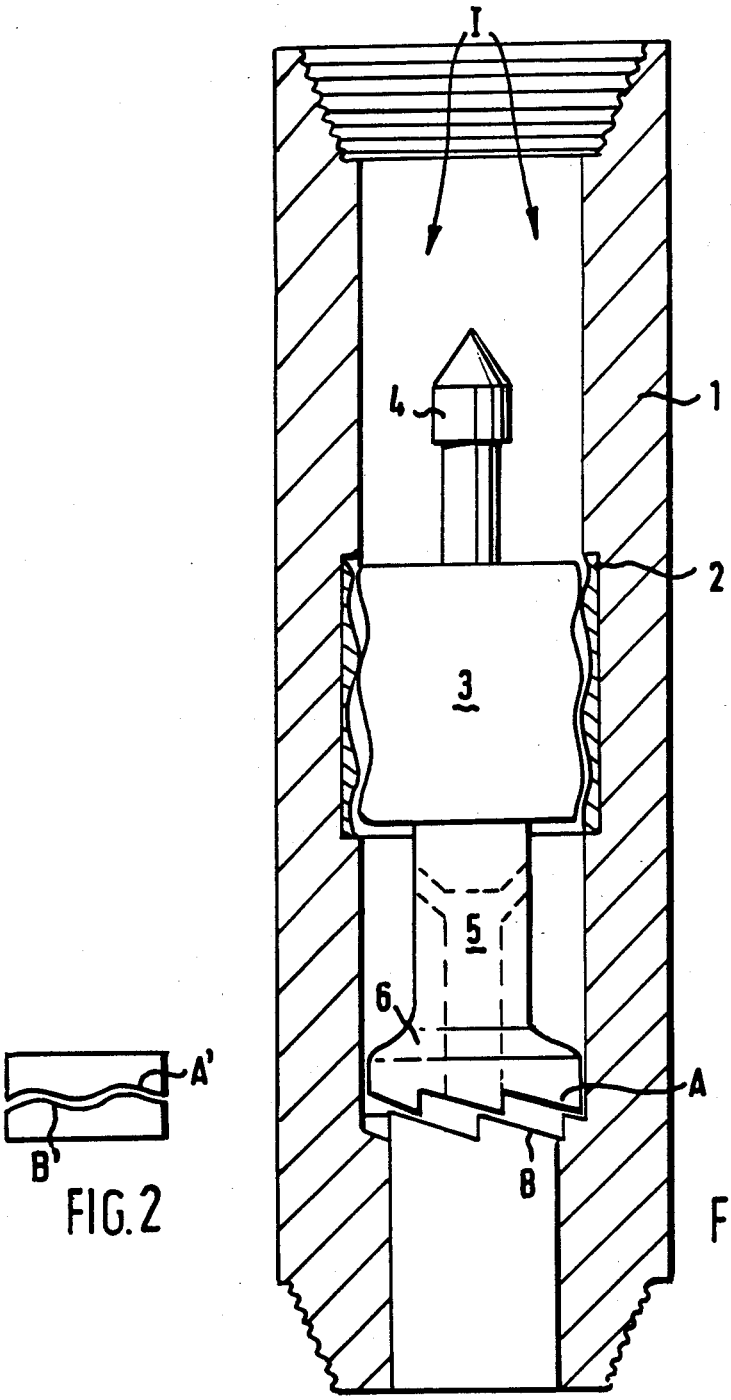
FIG. 1 is a schematic illustration of an apparatus according to the invention comprising a rotor which is caused to vibrate relative to a stator housing by means of a pair of mating saw-tooth profiles.
FIG. 2 is a lay-out view of an alternative profile having in circumpherential direction a sinusoidal shape.

In the embodiment of the apparatus illustrated in FIG. 1, the apparatus comprises an external mandrel 1, which is provided with a pair of tool joints for coupling the apparatus to adjacent drill pipes or drill collars (not shown) of a drill string. The inside of the upper part of this mandrel 1 is in the profile of the stator 2 or external part of a multilobe or single lobe moineau motor. Within this rotates a rotor 3 with a matching profile, driven by the drilling fluid flow (see arrows I). It may have a wireline fishing neck 4 on top. The lower part of the rotor is hollow with a bypass 5. At the lower end of the rotor 3 there is mounted a ring 6 which has a ring-shaped bottom surface in which a saw-tooth profile A is machined. This mates with a similar profile B on the mandrel 1. As the fluid flow passes the rotor 3 and stator 2, the rotor rotates and the saw-tooth profile A is held on the profile B by the thrust force of drilling fluid flow on the rotor 3. The type of exciting force can be varied depending on the profile chosen for the mating surfaces A and B. FIG. 2 shows an alternative type of profile wherein profiles A′ and B′ have a sinusoidal waveform. The rate of fluid flow through the drill string controls the frequency of the exciting force, and also the magnitude. The magnitude of the exciting force can be increased by increasing the mass of the rotor 3. The exciting vibrating force will also have a cross-axial component caused by the eccentric vibration of the rotor 3.

It is observed that the profile of a moineau motor is such that the rotor and stator still mate during longitudinal vibrations, although the instantaneous angular velocity may vary slightly.

In the event of access to the bore of the drill string being required below the device, the rotor assembly can be pulled with standard wireline fishing tools mating with the fishing neck 4 on top of the rotor. In this case the diameter of the rotor 3 should be smaller than the minimum internal diameter of the stator 2 and of the drill string series (not shown) above the apparatus. Calculations and experimental verification are used to determine the likely frequency at which standing waves are set up in the drill string. Scouting experiments and calculations have shown that the frequency of the exciting force should generally be between 1 and 10 Hz. The rotor is designed such that it is induced by the saw-tooth profiles A, B to vibrate at that frequency at normal drilling fluid flow rates. When circulation starts, the flow rate may be varied slightly until some parameter such as penetration rate, bit weight, or vibration of the string at the surface or measured downhole, are optimized.

Figure 3:
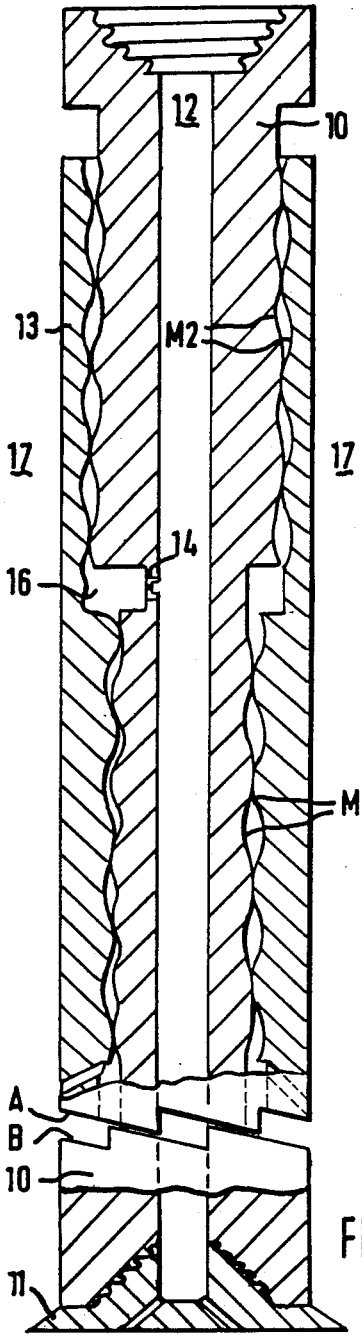
FIG. 3 is a schematic representation of another configuration of the apparatus in which the rotor part surrounds the stator part of the apparatus.

FIG. 3 shows an alternative embodiment of the apparatus according to the invention. In this embodiment the stator consists of a central mandrel 10 which may be mounted directly to and above a rotary drill bit 11, or at some other location in the drill string. On the outside of this mandrel is located a rotating sleeve 13. On the inside of the sleeve 13 and the outside of the mandrel 10 are two matching sets of moineau motor profiles M1 and M2. These have the same pitch and eccentricity but the radius of the upper profile M2 is greater than the radius of the lower profile M1, and they are handed, or pitched, in different directions. During drilling the majority of the drilling fluid flows through the interior of the drill string (not shown) via a longitudinal bore 12 inside the central mandrel into the drill bit 11. Part of the drilling fluid flows from the central bore 12 via a nozzle 14 enters the chamber 16 and is then divided into two, one part flows through moineau profile M1, the other through profile M2. Because the radius of profile M2 is greater than M1 the differential pressure between the pipe-formation annulus 17 surrounding the sleeve 13 pushes the sleeve downwards. Due to the moineau profiles there is also rotational force rotating the sleeve 13. At the bottom of the sleeve 13 there is a saw-tooth profile A, with a matching profile B on the mandrel 10. The longitudinal force created by the differential pressure on the sleeve 13 keeps the two saw-tooth profiles A and B together as the sleeve 13 rotates relative to the mandrel 10. If the profiles A and B have a saw-tooth form then rotation of the sleeve creates a hammering motion with a high forward or downward motion and resultant impact on the profile B and a lower return force. This hammering motion or other type of longitudinal vibration is transmitted to the mandrel 10 by the contact at the profiles A and B and so to the rest of the drill string. The vibration of the drill string may be of a saw-tooth type, or sinusodial type, depending on the shape of the profiles A and B. In the case of the "saw-tooth" profiles, it may be possible to design a rotating vibrator and drill string system so that the forward or downward impact of the sleeve 13 hammers the string forward with a force greater than static friction between the drill string and hole wall, while on the return "stroke" of the sleeve 13 the reaction force between the hole wall and the drill string will be below the static friction and therefore the string will not move backwards. There will also be a lateral vibration due to the excentric vibration of the sleeve 13. In this way the drill string in a highly deviated or horizontal hole can be advanced, and bit weight maintained. The drill string may or may not be rotated.

The longitudinal force holding the profiles A and B together is dependent on the difference in the radii of moineau motor profiles M1 and M2 and on the differential pressure between the chamber 16 and the pipeformation annulus 17.

If the nozzle 14 is enlarged then the force will be increased. This however may lead to too large a part of the circulating drilling fluid passing the moineau profiles M1 and M2. This may be avoided by varying the detailed design of the profile M1 and M2.

As an alternative the upper moineau profile M2 may be replaced by a sealing mechanism which will seal across the differential pressure between the chamber 14 and the pipe-formation annulus 17, while allowing the sleeve 13 to rotate eccentrically and vibrate longitudinally about the mandrel 10.

Figure 4:
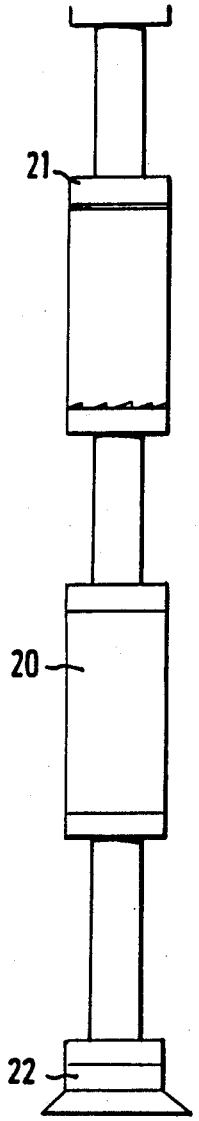
FIG. 4 illustrates a drilling assembly in which a shock absorber is mounted between the drill bit and vibrating apparatus according to the invention.

If as illustrated in FIG. 4 a shock absorber 20 is placed between the vibrating apparatus 21 according to the invention, and the drill bit 22 then the force on the bit will be averaged out so that the bit can drill without the use of heavy drill collars and longitudinal force (bit weight) variations on the bit are minimized.

Figure 5:
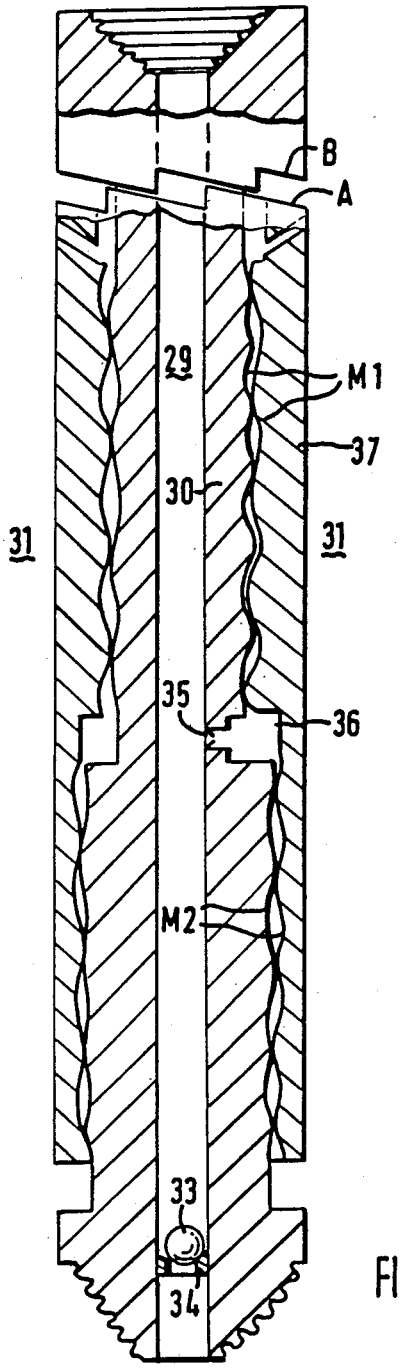
FIG. 5 is a schematic representation of yet another configuration of the apparatus which is particularly suitable for jarring a stuck drill string from a borehole.

In FIG. 5 there is shown another configuration of the apparatus according to the invention wherein the apparatus forms a fishing or drilling jar. In this configuration during normal drilling operations circulation of drilling fluid may be maintained down through a central bore 29 formed inside a central mandrel 30 of the apparatus and up the pipe-formation annulus 31.

In the event that it is required to start jarring, a ball 33 is dropped down the drill string to sit on a seat 34 located near the lower end of the central bore 29 formed inside the mandrel 30. The drill string above the apparatus is then pressured up against the ball 33 and a shear disc 35 is burst.

The entire flow is then directed into a fluid inlet chamber 36 and then to two moineau motor profiles M1 and M2 formed between the mandrel 30 and a sleeve 37 surrounding the mandrel and out to the annulus 31.

Alternative ways may be used to direct all or some of the flow into the chamber 36 for example the shear disc 35 may be replaced by an excess pressure valve and the ball 33 may be replaced by an excess pressure valve and the ball 33 may be replaced by a bar with a sealing profile on the bottom and a wireline fishing neck on the top, thus allowing circulation and/or drilling to continue after jarring. Electro-magnetic or mud pulse telemetry; rotation; tension; and/or other ways may be used to initiate and maintain the diversion of flow from the bore of the jar to chamber 36. The moineau motor profiles M1 and M2 have the same excentricity and pitch but are handed or pitched in different directions. The radius of the lower moineau profile M2 is greater than that of the upper profile M1.

The differential pressure between the chamber 36 and the pipe-formation annulus 31 forces the sleeve 37 upward. The flow of drilling fluid through the moineau motor profiles M1 and M2 rotate the sleeve and the saw-tooth profiles A and B cause the sleeve 37 as it rotates to impart an upward jarring motion on the central mandrel 30 and on the drill string. If instead of a saw-tooth profile a sinusodial type profile is used (see FIG. 2) then the force exerted by the sleeve on the mandrel (and hence on the drilling string) is of a sinusodial type.

In use the performance of the jar with the sinusoidal type profile would be enhanced if it were possible to set up standing waves in the drill string or fishing string near the stuck point. Such wavers could be set up so that the string is in resonance with the maximum force being at the struck point. This force could be increased by applying torque and tension from the surface onto the fishing string or drill string.

The performance of a jarring apparatus with a given geometry could be optimized by varying the flow rate through the apparatus and hence the rotational speed of the sleeve and hence the frequency of the exciting force. Very sensitive pressure measurements on surface would enable the rotational speed and/or the blow frequency of sleeve 37 to be measured. It may also be possible to measure these by a microphone attached to the drill string on surface.

The differential pressure across the jarring apparatus, i.e., between chamber 36 and the pipe-formation annulus 31, may be estimated by substracting the drill/fishing string internal and external pressure drops for the given flow rate from the standpipe pressure. This differential pressure is proportional to the torque output of the moineau profiles M1 and M2, after correcting for efficiency. Said differential pressure may be a suitable variable for adjusting flow rate to maximize jarring efficiency.

It may be possible to measure vibration downhole and transmit the information to surface. These data could then be used to optimise the flow rate, and thus optimise the exciting force and/or frequency, and thus maximize the force on the stuck drill string at the stuck point due to the standing waves. Alternatively the vibration measured downhole could be used to optimise the performance of the jarring apparatus. The vibration signal would be fed to a downhole microprocessor which would control a valve replacing the shear disc 35.

It will be understood that any type of hydraulic motor may be used to induce the profiles A and B to generate longitudinal vibrations in response to flow of fluid through the motor. Suitable motors are the moineau type motors illustrated in the drawing and turbine motors.

As an alternative way of creating a vibration force downhole a "positive" or "negative" mud pulser could be manipulated in the drilling fluid flow under control of downhole electronics and accelerometers such that the accelerations and/or forces, and/or movement of the apparatus are optimised such as to give maximum force to the drill string at the stuck point due to the optimised standing waves. The mud pulser may consist of a heavy body which moves in an oscillating manner in axial direction relative to the string in response to flow of drilling mud or other fluids through the interior of said string.

It will further be understood that the jarring apparatus according to the invention can be used to advance a pipe string either in downward or in upward direction through a borehole. The pipe string may consist of a drill string or other tubulars located in a well, such as production liners or casing strings, gravel pack screens, etc. The vibrating motion of the apparatus according to the invention may further be used for compaction of e.g. gravel packings and cement linings in a well.

Various other modifications of the present invention will become apparent to those skilled in the art from the foregoing description and accompanying drawings.

Such modifications are intended to fall within the scope of the appended claims.

What is claimed is:

1. An apparatus for vibrating a drill string having a central axis in a borehole, the apparatus comprising means for generating at a downhole location longitudinally directional vibrations along the central axis of the drill string in response to flow of fluid through the interior of said drill string and a shock absorbing element mounted in the drill string between the apparatus and a drill bit carried by said drill string effective to substantially isolate the drill bit from the vibration induced in the drill string.

2. An apparatus in accordance with claim 1, wherein the means for generating said longitudinal vibrations comprises a body which moves in an oscillating manner in axial direction relative to the drill string in response to flow of fluid through the interior of said drill string.

3. An apparatus in accordance with claim 1, wherein the means for generating said vibrations comprises:

a hydraulic motor comprising:
a stator part forming part of the drill string;
a rotor part; and
a device coupled to the rotor part which axially moves the rotor part relative to the stator part during the course of each rotation of the rotor part relative to the stator part.

4. The apparatus of claim 3, wherein the device consists of a pair of percussion rings having mating surfaces which have in circumferential direction a rugged profile, one of said rings being connected to said rotor part, the other ring being connected to said stator part.

5. An apparatus in accordance with claim 4, wherein said rugged profile is a saw-tooth profile.

6. An apparatus in accordance with claim 3, wherein the hydraulic motor is of the turbine type.

7. An apparatus for vibrating a drill string having a central axis in a borehole, the apparatus comprising:

means for generating at a downhole location longitudinal vibrations along the central axis of the drill string in response to flow of fluid through the interior of said drill string, said means for generating said vibrations comprising:
a Moineau-type hydraulic motor comprising:
a stator part forming part of the drill string;
a rotor part; and
a device coupled to the rotor part which axially moves the rotor part relative to the stator part during the course of each rotation of the rotor part relative to the stator part, said device comprising a pair of percussion rings having mating surfaces which have in circumferential direction a rugged profile, one of said rings being connected to said rotor part, the other ring being connected to said stator part.

8. An apparatus in accordance with claim 7, wherein the stator part forms a motor housing and the rotor part is mounted inside said motor housing.

9. An apparatus in accordance with claim 8, wherein the rotor part and the percussion ring connected thereto are mounted in such a manner in the motor housing that they can be retrieved therefrom via the interior of the drill string above the motor housing.

10. The apparatus of claim 7, wherein the stator part consists of a pair interconnected stator sections and the rotor part a consists of a pair of interconnected rotor sections which surround each one of said stator sections, thereby forming a pair of interconnected moineau motor sections having a common inlet which is located between said motor sections and is in fluid communication with a central bore formed through both stator sections, the rotor and stator sections of said motor sections having cooperating moineau profiles with opposite pitches, different average pitch radii but the same eccentricity.

11. An apparatus in accordance with claim 10, further comprising flow diverting means for regulating the amount of drilling fluid transferred via the central bore and inlet into each of said motor sections.

12. An apparatus for vibrating a pipe string having a central axis in a borehole, the apparatus comprising:

a moineau-type hydraulic motor comprising:
a central bore;
a stator part comprising pair of interconnected stator sections which form part of the drill string;
a rotor part comprising a pair of interconnected rotor sections which surround said stator sections;
a pair of moineau motor sections, each comprising one of said rotor sections paired with one of said stator sections and presenting cooperating moineau profiles with opposite pitches, different average pitch radii; and substantially the same eccentricity;
a common inlet located between said moineau motor sections and in fluid communication with the central bore through both stator sections; and
means for diverting the flow to regulate the amount of drilling fluid transferred via the central bore and the common inlet into each of the moineau motor sections; and
a device coupled to the rotor part which axially moves the rotor part relative to the stator part during the course of each rotation of the rotor part relative to the stator part, said device comprising:

a pair of percussion rings having mating surfaces which have a circumpherential direction a rugged profile, one of said rings being connected to the rotor part and the other ring to the stator part.

13. An apparatus in accordance with claim 12, wherein said rugged profile is a saw-tooth profile.

14. An apparatus in accordance with claim 12, wherein said rugged profile has a sinusoidal shape.

15. An apparatus for vibrating a drill string having a central axis in a borehole, the apparatus comprising a means for generating at a downhole location longitudinal vibrations along the central axis of the drill string in response to the flow of fluid through the interior of the drill string, said vibration generating means comprising:

a moineau-type hydraulic motor comprising:

a central bore;

a stator part forming a motor housing as a part of the drill string;

a rotor part mounted inside the motor housing; and a device coupled to the rotor part which axially moves the rotor part relative to the stator part during the course of each rotation of the rotor part relative to the stator part, said device comprising:

a pair of percussion rings having mating surfaces which have a rugged profile in a circumferential direction, one of said rings being connected to the rotor part and the other ring to the stator part.

16. An apparatus in accordance with claim 15, wherein the rotor part and the percussion ring connected thereto are mounted in such a manner in the motor housing that they can be retrieved therefrom via the interior of the drill string above the motor housing.

17. The apparatus of claim 15, wherein the stator part consists of a pair of interconnected stator sections and the rotor part consists of a pair of interconnected rotor sections which surround each one of said stator sections, thereby forming a pair of interconnected moineau motor sections having a common inlet which is located between said motor sections and is in fluid communication with a central bore formed through both stator sections, the rotor and stator sections of said motor sections having cooperating moineau profiles with opposite pitches, different average pitch radii but the same eccentricity.

18. An apparatus in accordance with claim 17, further comprising flow diverting means for regulating the amount of drilling fluid transferred via the central bore and inlet into each of said motor sections.

19. A method of feeding a drill string through a non-vertical section of borehole comprising:

generating at a downhole location a longitudinally directional vibration along the central axis of the drill string by oscillating a body in an axial direction relative to the drill string in response to flow of fluid through the interior of the drill string, said vibrations preventing frictional sticking of the drill string against the borehole wall;

isolating a drill bit at the end of the drill string from the effects of the vibration during drilling operations; and moving the pipe longitudinally in the borehole.

20. An apparatus for vibrating a drill string having a central axis in a borehole, the apparatus comprising:

means for generating at a downhole location longitudinal vibrations along the central axis of the drill string in response to flow of fluid through the interior of said drill string, said means for generating said vibrations comprising:

a hydraulic motor comprising:

a stator part forming part of the drill string;

a rotor part; and a device coupled to the rotor part which axially moves the rotor part relative to the stator part during the course of each rotation of the rotor part relative to the stator part, said device comprising a pair of percussion rings having mating surfaces which have in circumferential direction a rugged profile in a sinusoidal shape, one of said rings being connected to said rotor part, the other ring being connected to said stator part.

* * * * *